US008047681B2

(12) United States Patent
Howng et al.

(10) Patent No.: US 8,047,681 B2
(45) Date of Patent: Nov. 1, 2011

(54) FLEXIBLE LIGHT EMITTING ARRAY

(75) Inventors: Wei-Yean Howng, Hsinchu (TW); Ling King, Albuquerque, NM (US)

(73) Assignee: Royal Pacific Limited, Albuquerque, NM (US)

( * ) Notice: Subject to any disclaimer, the term of this patent is extended or adjusted under 35 U.S.C. 154(b) by 418 days.

(21) Appl. No.: 12/382,878

(22) Filed: Mar. 26, 2009

(65) Prior Publication Data

US 2010/0148704 A1 Jun. 17, 2010

(30) Foreign Application Priority Data

Dec. 16, 2008 (TW) ..... 97149003 A

(51) Int. Cl.
*F21S 4/00* (2006.01)

(52) U.S. Cl. ..... 362/249.04; 362/249.08; 362/249.15; 362/103; 362/800; 315/312; 315/318

(58) Field of Classification Search ..... 362/103, 362/249.02–249.16, 800, 806; 40/550, 586, 40/579, 581; 315/312, 316, 318, 362
See application file for complete search history.

(56) References Cited

U.S. PATENT DOCUMENTS

| | | | | |
|---|---|---|---|---|
| 4,308,572 | A * | 12/1981 | Davidson et al. | 362/103 |
| 4,709,307 | A * | 11/1987 | Branom | 362/103 |
| 7,278,760 | B2 * | 10/2007 | Heuser et al. | 362/293 |
| 2008/0109941 | A1 * | 5/2008 | Moreshead | 2/243.1 |

FOREIGN PATENT DOCUMENTS

| | | |
|---|---|---|
| TW | I246037 | 12/2005 |
| TW | M238952 | 12/2005 |
| TW | M325346 | 1/2008 |

* cited by examiner

*Primary Examiner* — Haiss Philogene
(74) *Attorney, Agent, or Firm* — Rosenberg, Klein & Lee

(57) ABSTRACT

A flexible light emitting array includes a flexible substrate, pluralities of first wires, second wires and light emitting components. The flexible substrate has a first surface and an opposite second surface. The first wires and the second wires penetrates across the first surface and the second surface to form pluralities of first conductive wire segments and second conductive wire segments on the first surface side and the second surface side. The light emitting components are arranged on the first surface side and electrically connected to the first conductive wire segments and the second conductive wire segments. The flexible light emitting array not only increases the reliability of bonding between the light emitting component and the flexible substrate but also drives the light emitting components with programmable control to achieve the dynamic effects.

13 Claims, 4 Drawing Sheets

FLEXIBLE LIGHT EMITTING ARRAY

BACKGROUND OF THE INVENTION

1. Field of the Invention

The present invention relates to a light emitting array, and more particularly to a flexible light emitting array.

2. Description of the Prior Art

The conventional fabric is made of proper materials of animals, plants or chemical fibers. Mounting the desired pattern on the fabric by means of printing, dyeing, sewing, embroidering or directly weaving during the process so as to beautify the fabric and increase its aesthetic appearance. By incorporating the fabric with active light emitting components will not only be able to increase the space impression and uniqueness of the fabric, but also have the additional effect of increasing the visibility to serve as warning.

Referring to FIG. 1, Taiwan patent No. M325346 discloses a structure of light emitting fabric, wherein the light emitting pattern 12 comprising of a conductive layer, a light emitting layer, and a transparent electrode layer is arranged on the surface of fabric 11. The power supply 13 provides the requested power for light emitting pattern 12 while emitting light. The style of light emitting pattern 12 can not be changed as the light emitting pattern 12 is fixed on the surface of the fabric 11. Therefore, this would be less appealing and less attractive to the consumer as the light emitting pattern 12 lacks the dynamic effects.

Referring to FIG. 2, Taiwan patent No. M283952 discloses a cloth with light emitting device, wherein the light emitting pattern 12 is incorporated with the fabric 11 via a connecting component 20. According to foresaid structure, the user may change to the favorite light emitting pattern 12 anytime for satisfying the user's need. However, the light emitting pattern 12 is still fixed in position and lacks the dynamic effects.

One approach to increase dynamic effects of light emitting fabric would be to incorporate a flexible light emitting array into fabric. Taiwan patent No. I246037 discloses a flexible light emitting array which comprises of a flexible substrate and light emitting components, wherein the flexible substrate is made by high molecular weight polymer, such as plastic, polyimide (PI), or polyethylene (PE). It is not suitable for incorporating with ordinary fabric as the flexible substrate made of high molecular weight polymer is airproof and has a hard texture impeding its application for making wearable clothes.

To sum up, the above-mentioned disadvantages exist in the prior arts. Therefore, how to incorporate the flexible light emitting array with fabric to beautify the fabric, increase its esthetic appearance and dynamic effects is a current goal to be achieved.

SUMMARY OF THE INVENTION

The present invention is directed to a flexible light emitting array, wherein conductive wires are incorporated with the fabric by means of knitting and a plurality of light emitting components respectively connected to a plurality of sets of wires are driven by a programmable controller to achieve the dynamic effects.

In one embodiment, the proposed flexible light emitting array includes a flexible substrate, pluralities of first wires, second wires and light emitting components. The flexible substrate comprises of a first surface and an opposite second surface and is made of an insulating material. The first wires and the second wires penetrate from the first surface to the second surface and vice-versa to respectively form a plurality of first conductive wire segments and second conductive wire segments on the first surface and the second surface, wherein the first conductive wire segments and the second conductive wire segments mutually crossing each other are respectively arranged on opposite sides of the flexible substrate. The light emitting component is arranged on the first surface and is electrically connected to the first conductive wire segments and the second conductive wire segments.

The objective, technologies, features and advantages of the present invention will become apparent from the following description in conjunction with the accompanying drawings wherein are set forth, by way of illustration and example, certain embodiments of the present invention.

BRIEF DESCRIPTION OF THE DRAWINGS

The foregoing conceptions and their accompanying advantages of this invention will become more readily appreciated after being better understood by referring to the following detailed description, in conjunction with the accompanying drawings, wherein.

DESCRIPTION OF THE PREFERRED EMBODIMENT

The detailed explanation of the present invention is described as following. The described preferred embodiments are presented for purposes of illustrations and description, and they are not intended to limit the scope of the present invention.

Figure 1:
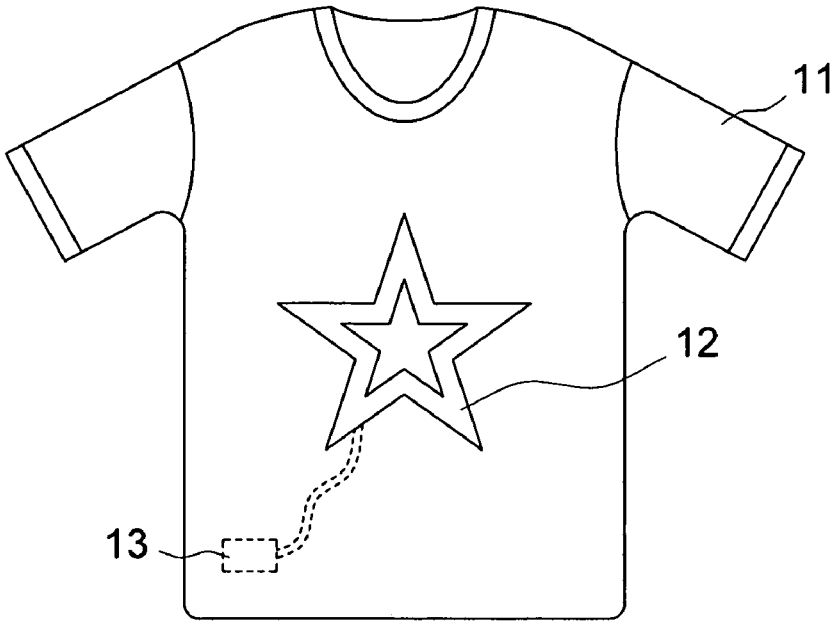
Fig. 1 (prior art)
FIG. 1 is a diagram schematically illustrating a structure of light emitting fabric according to a prior art.
Figure 2:
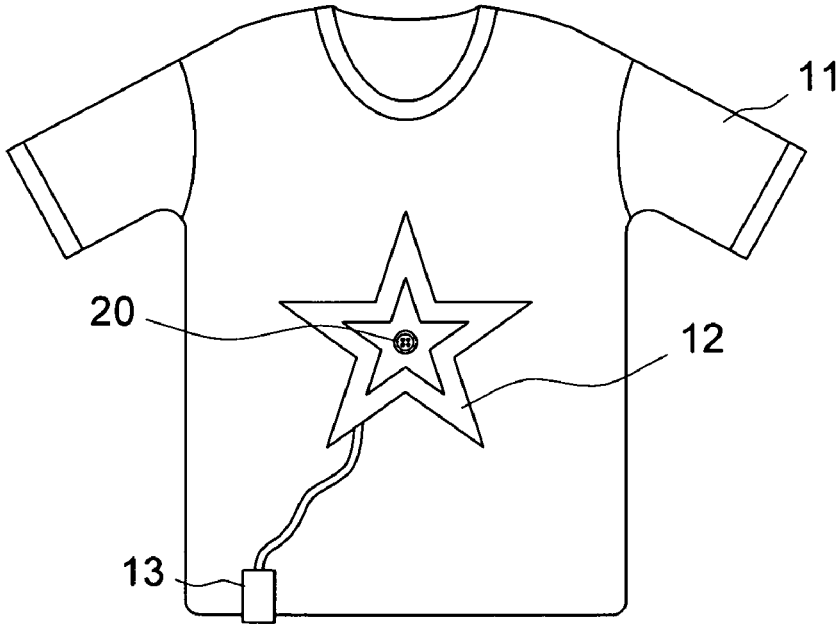
Fig. 2 (prior art)
FIG. 2 is a diagram schematically illustrating a cloth with light emitting device according to a prior art.
Figure 3A:
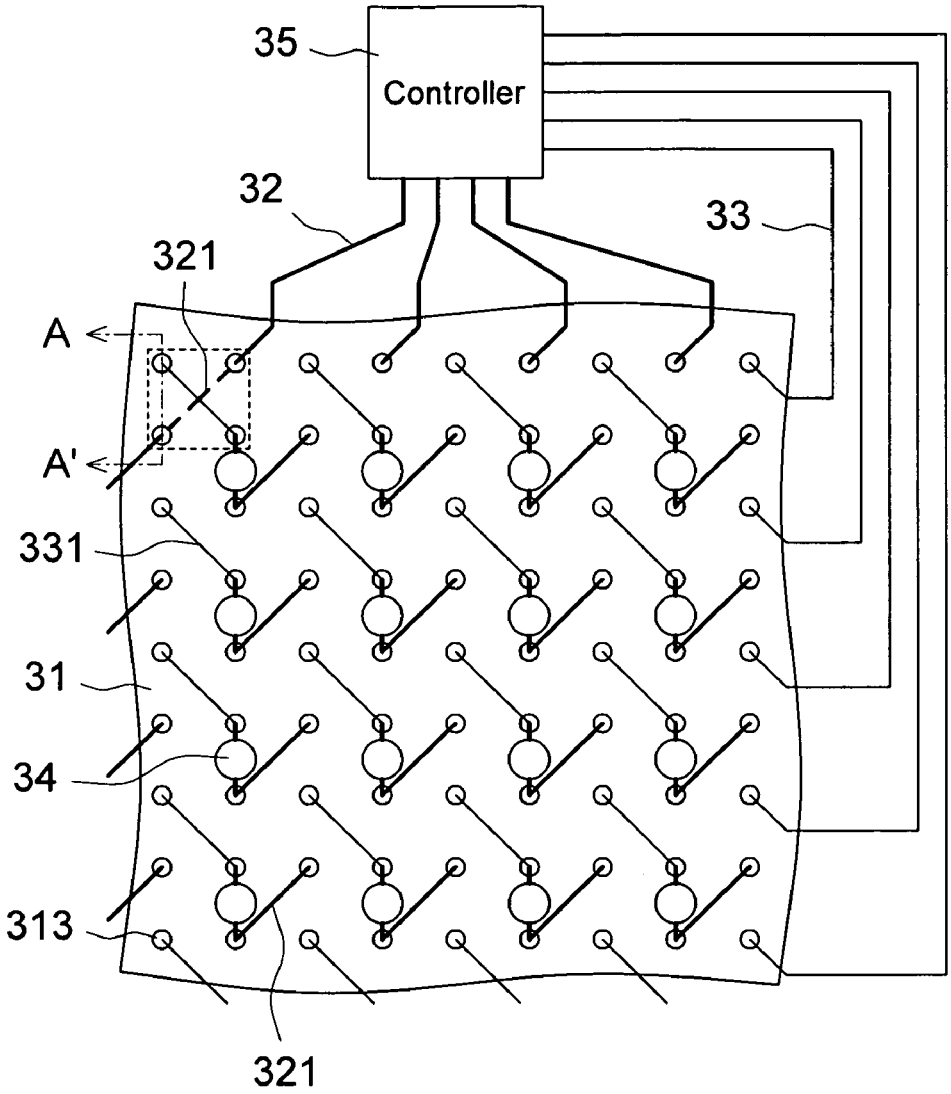
FIG. 3*a* is a diagram schematically illustrating a flexible light emitting array according to an embodiment of the present invention.
Figure 3B:
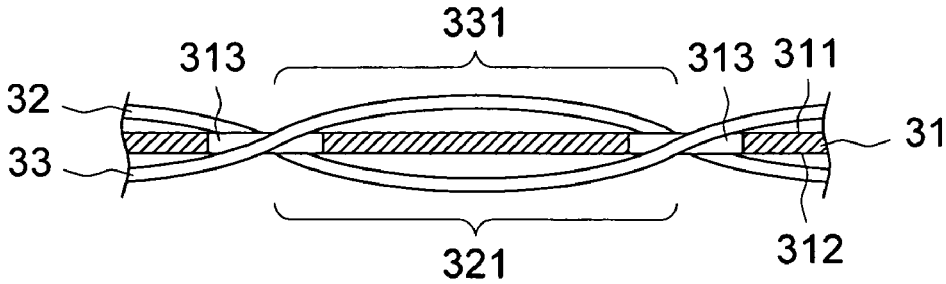
FIG. 3*b* is a cross-sectional view along the line AA' line in FIG. 3*a;*

Referring to FIGS. 3*a* and 3*b*, in accordance with one embodiment, the flexible light emitting array comprises a flexible substrate 31, a plurality of first wires 32, a plurality of second wires 33 and a plurality of light emitting components 34. The flexible substrate 31 comprises a first surface 311 and an opposite second surface 312, and is comprised of an insulating material. For example, the flexible substrate 31 comprises a textile fabric, a knitted fabric, leather, or any combination thereof. In the present embodiment, the flexible substrate 31 may be a fabric that can be worn or as ornament including clothing, underwear, curtain, tablecloth or ornamental fabrics.

The first wires 32 continuously penetrate across the first surface 311 and the second surface 312 of the flexible substrate 31 to respectively form a plurality of first conductive wire segments 321 on the first surface 311 side and the second surface 312 side. Similarly, the second wires 33 continuously penetrate across the first surface 311 and the second surface 312 of the flexible substrate 31 to respectively form a plurality of second conductive wire segments 331 on the first surface 311 side and the second surface 312 side.

It should be noted that the first conductive wire segments 321 and the second conductive wire segments 331 mutually crossing each other are respectively arranged on the opposite sides of the flexible substrate 31 to avoid short circuit. As illustrated in the dotted line in FIG. 3*a*, for example, the first conductive wire segments 321 are arranged on the second surface 312 of the flexible substrate 31 and the second conductive wire segments 331 are arranged on the first surface 311 of flexible substrate 31.

The light emitting components 34 are arranged on the first surface 311 of the flexible substrate 31 and electrically connected to the first conductive wire segments 321 and the second conductive wire segments 331. The first conductive wire segments 321 and the second conductive wire segments 331 are capable of providing the required power or control signals to the light emitting components 34 for operation. For example, the light emitting component 34 is soldered onto the first conductive wire segments 321 and the second conductive wire segments 331. The light emitting component 34 may be a light emitting diode (LED).

In one embodiment, the flexible light emitting array further comprises a controller 35. The controller 35 is electrically connected to the first wires 32 and the second wires 33 to control and drive the light emitting component 34. The control and driving of the light emitting component 34 can be programmed. For example, a plurality of light emitting components 34 are arranged to form a matrix. The controller 35 provides power or outputs control signal to selected first wires 32 and second wires 33 for making the light emitting components 34 at predetermined regions to emit light so as to form a predetermined light emitting pattern. In accordance with the foresaid structure, the light emitting array of the present embodiment is able to form a predetermined light emitting pattern (such as letters, words or phrases) on the fabric and provide the dynamic effects (such as scrolling text marquee or advertisement).

In a case when the flexible substrate 31 is comprised of a leather or leather alike material, the flexible substrate 31 comprises a plurality of holes 313 for facilitating the first conductive wire segments 321 and the second conductive wire segments 331 to mutually cross between the first surfaces 311 and the second surfaces 312 of the flexible substrate 31. The holes 313, that two ends of the first conductive wire segments 321 and the second conductive wire segments 331 mutually crossing each other penetrate through, are respectively arranged in a diagonal configuration, as illustrated by the dotted line region in FIG. 3*a*. It should be noted that the aforementioned leather comprises a genuine leather or leatherette.

Figure 4:
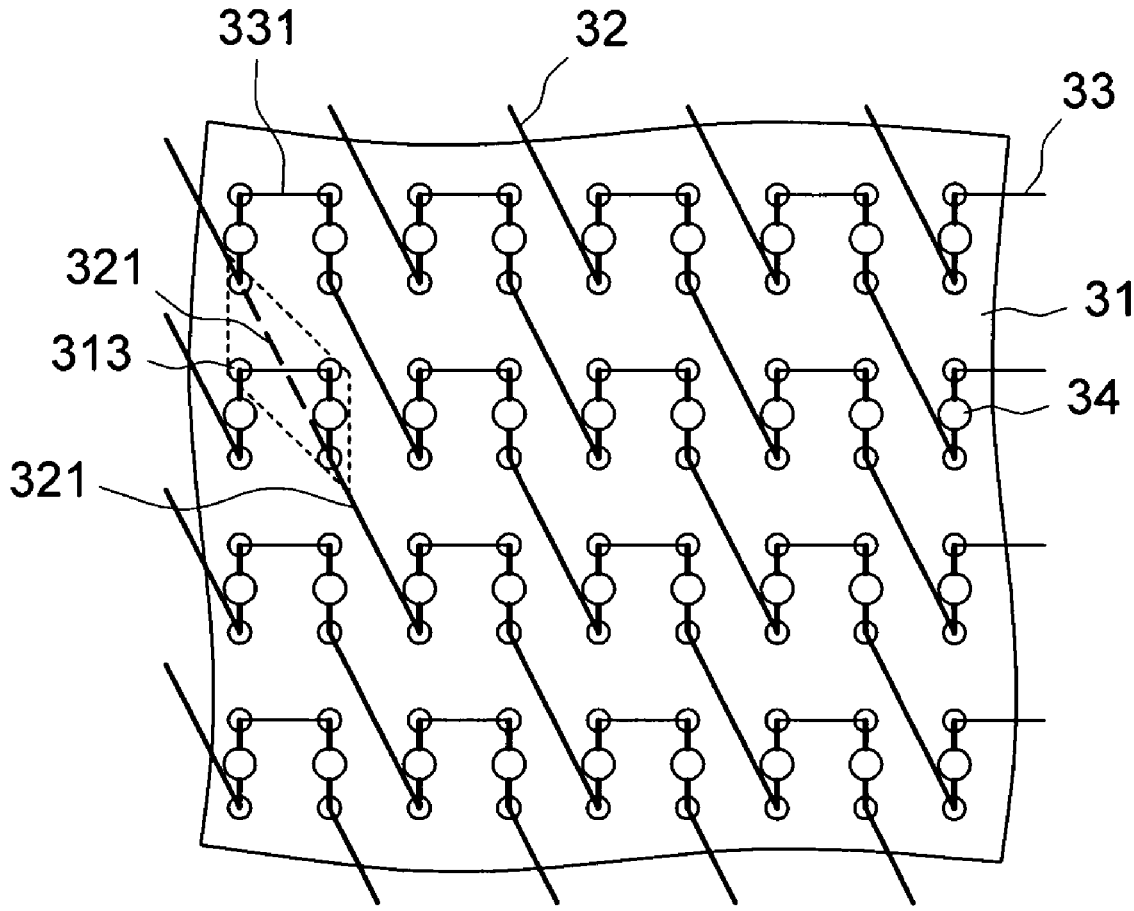
FIG. 4 is a diagram schematically illustrating a flexible light emitting array according to an embodiment of the present invention.

It should be noted that the method of knitting the first wires 32 and the second wires 33 and the arrangement of the light emitting components 34 are not limited to the aforesaid description. For example, as illustrated in FIG. 4, the first wires 32 may be obliquely penetrated through the flexible substrate 31 with longer distance to form longer first conductive wire segments 321; the second wires 33 may be horizontally penetrated through the flexible substrate 31 to form shorter second conductive wire segments 331; and the light emitting components 34 may be more tightly arranged. It should be noted that, as illustrated in the dotted line region in FIG. 4, the holes 313 that two ends of the first conductive wire segments 321 and the second conductive wire segments 331 mutually crossing each other penetrate through are still arranged in a diagonal configuration.

Figure 5A:
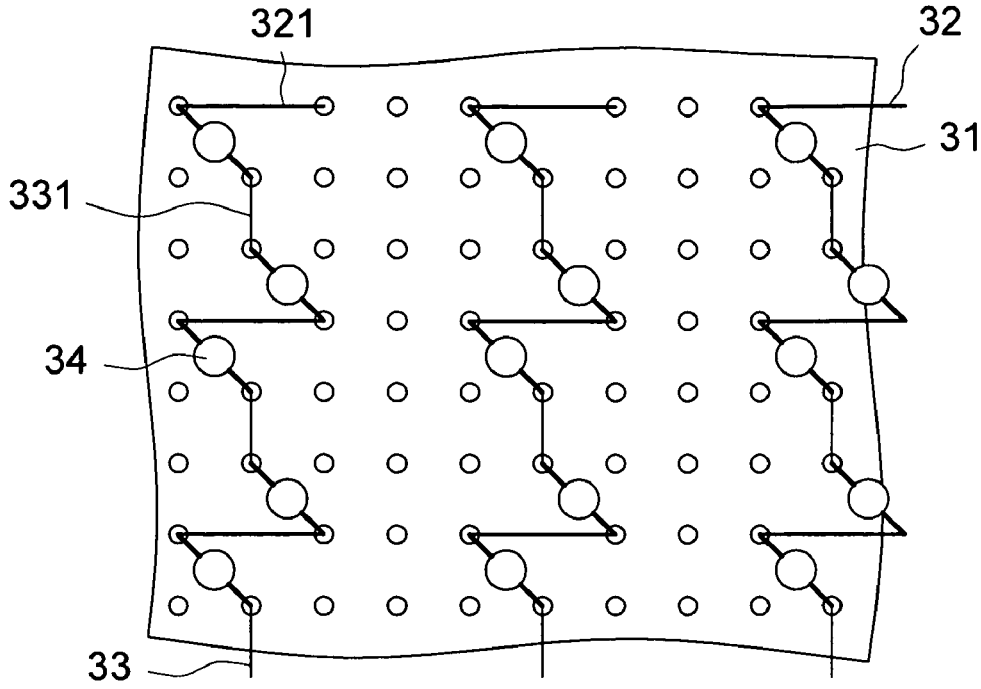
FIG. 5*a* and FIG. 5*b* are diagrams schematically illustrating a flexible light emitting array according to an embodiment of the present invention.
Figure 5B:
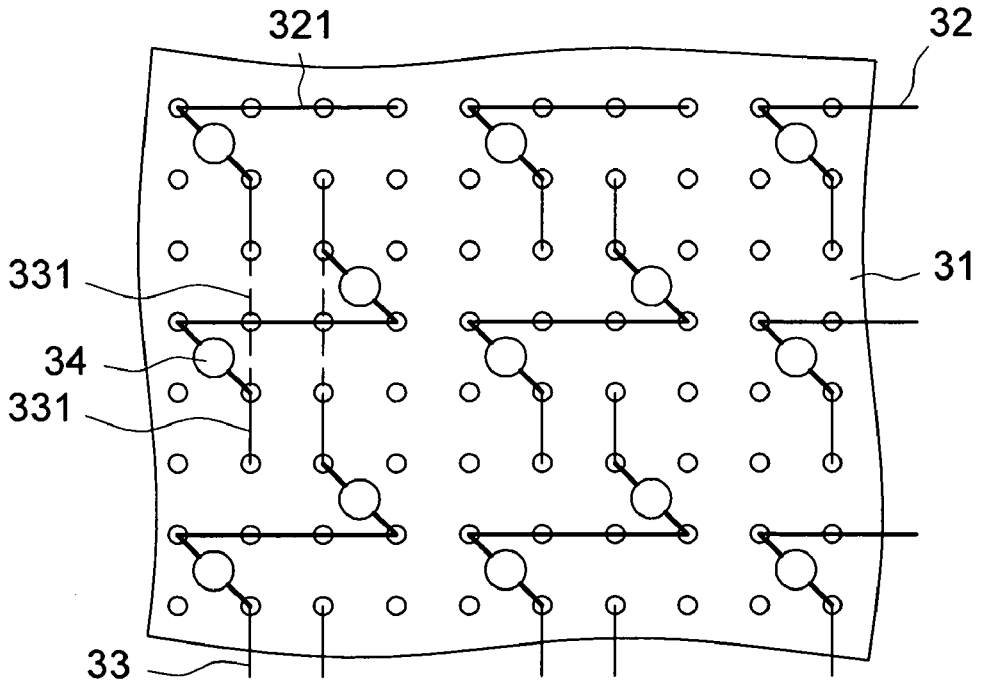

In addition, the first wires 32 or the second wires 33 may also penetrate through the flexible substrate 31 at irregular distances. In the embodiment illustrated in FIG. 5*a*, the second wires 33 form a shorter second conductive wire segments 331 on the first surface 311 of the flexible substrate 31 and form a longer second conductive wire segments 331 on the second surface 312 (not shown as it is the opposite side with respect to the first surface 311) of the flexible substrate 31 (as shown by the dotted lines) for crossing the first conductive wire segments 321. In another embodiment, the same first conductive wire segment 321 and the second conductive wire segments 331 may also be mutually and alternately arranged, as illustrated in FIG. 5*b*. On the contrary, the same second conductive wire segment 331 and the first conductive wire segments 321 may also be mutually and alternately arranged. It is should be noted that in the case of the holes 313 on the flexible substrate 31, between the first conductive wire segments 321 and the second conductive wire segments 331 opposite to each other, do not cause the short circuit, the holes 313 in the flexible substrate 31 need not need be intentionally avoided, as illustrated in FIG. 5*b*.

In one embodiment, the first wire 32 and the second wire 33 comprise of gold, silver, copper, platinum, aluminum, an alloy comprising at least one of the above materials, or one metal coated on the other. The first wires 32 and the second wires 33 of foresaid materials knitting on the flexible substrate 31 will not only be conductive, but also beautify the fabric with a preferred metal color, or the first wire 32 and the second wire 33 comprise colored insulation layer, arranged on the surface of the first wire 32 and second wire 33 may also achieve the same purpose. It should be noted that the conductive wire constituent is not limited to the aforementioned elements.

To summarize the foregoing descriptions, the flexible light emitting array of the present invention incorporates the first wires and the second wires with the flexible substrate by means of knitting the first wires and the second wires to the flexible substrate. This structure not only increases the reliability of bonding between the light emitting component and the flexible substrate but also drives the light emitting components with a programmable control to achieve the dynamic effects.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A flexible light emitting array comprising:

a flexible substrate, comprising a first surface and a opposite second surface, and comprised of an insulating material;

a plurality of first wires, penetrating across the first surface and the second surface to respectively form a plurality of first conductive wire segments on the first surface and the second surface;

a plurality of second wires, penetrating across the first surface and the second surface to respectively form a plurality of second conductive wire segments on the first surface and the second surface, wherein the first conductive wire segments and the second conductive wire segments mutually crossing each other are respectively arranged on opposite sides of the flexible substrate; and a plurality of light emitting components, arranged on the first surface and electrically connected to the first conductive wire segments and the second conductive wire segments.

2. A flexible light emitting array according to claim 1, wherein the flexible substrate comprises a plurality of holes, and the holes that two ends of the first conductive wire segments and the second conductive wire segments mutually crossing each other penetrate through are respectively arranged in a diagonal configuration.

3. A flexible light emitting array according to claim 1, wherein the light emitting components are arranged in a matrix.

4. A flexible light emitting array according to claim 1, further comprising a controller, electrically connected to the first wires and the second wires, for programming the ON/OFF of specific light emitting components.

5. A flexible light emitting array according to claim 1, wherein a plurality of the second conductive wire segments and the same first conductive wire segments are mutually and alternately arranged.

6. A flexible light emitting array according to claim 1, wherein a plurality of the first conductive wire segments and the same second conductive wire segments are mutually and alternately arranged.

7. A flexible light emitting array according to claim 1, wherein the flexible substrate comprises a textile fabric, a knitted fabric, a leather, or any combination thereof.

8. A flexible light emitting array comprising:

a flexible substrate, comprising a first surface and a opposite second surface, and comprised of an insulating material;

a plurality of first wires, penetrating across the first surface and the second surface to respectively form a plurality of first conductive wire segments on the first surface and the second surface;

a plurality of second wires, penetrating across the first surface and the second surface to respectively form a plurality of second conductive wire segments on the first surface and the second surface, wherein the first conductive wire segments and the second conductive wire segments mutually crossing each other are respectively arranged on opposite sides of the flexible substrate; and a plurality of light emitting components, arranged on the first surface and electrically connected to the first conductive wire segments and the second conductive wire segments;

wherein the flexible substrate comprises a textile fabric, a knitted fabric, a leather, or combination thereof.

9. A flexible light emitting array according to claim 8, wherein the flexible substrate comprises a plurality of holes, and the holes that two ends of the first conductive wire segments and the second conductive wire segments mutually crossing each other penetrate through are respectively arranged in a diagonal configuration.

10. A flexible light emitting array according to claim 8, wherein the light emitting components are arranged in a matrix.

11. A flexible light emitting array according to claim 8, further comprising a controller, electrically connected to the first wires and the second wires, for programming the ON/OFF of specific light emitting components.

12. A flexible light emitting array according to claim 8, wherein a plurality of the second conductive wire segments and the same first conductive wire segment are mutually and alternately arranged.

13. A flexible light emitting array according to claim 8, wherein a plurality of the first conductive wire segments and the same second conductive wire segment are mutually and alternately arranged.

* * * * *